US007290310B2

(12) United States Patent
Yamaguchi

(10) Patent No.: US 7,290,310 B2
(45) Date of Patent: Nov. 6, 2007

(54) HINGE

(75) Inventor: Koshi Yamaguchi, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 191 days.

(21) Appl. No.: 10/536,886

(22) PCT Filed: Dec. 2, 2003

(86) PCT No.: PCT/JP03/15382

§ 371 (c)(1),
(2), (4) Date: Jun. 1, 2005

(87) PCT Pub. No.: WO2004/051039

PCT Pub. Date: Jun. 17, 2004

(65) Prior Publication Data

US 2006/0107489 A1 May 25, 2006

(30) Foreign Application Priority Data

Dec. 3, 2002 (JP) ..... 2002-351489

(51) Int. Cl.
*E05D 7/00* (2006.01)
*E05D 11/00* (2006.01)

(52) U.S. Cl. ..... 16/273; 16/234

(58) Field of Classification Search ..... 16/273–275, 16/221, 247, 337, 372, 380, 385–387, DIG. 13, 16/DIG. 27
See application file for complete search history.

(56) References Cited

U.S. PATENT DOCUMENTS 179,409 A * 7/1876 Hopkins ..... 16/273
502,706 A * 8/1893 Corscaden et al. ..... 16/273
1,027,716 A * 5/1912 Fletcher ..... 16/273
1,053,900 A * 2/1913 Bradley ..... 16/387
3,216,053 A * 11/1965 Felix ..... 16/380
3,991,436 A * 11/1976 Nagase ..... 16/273
4,573,239 A * 3/1986 Valenti et al. ..... 16/273
4,675,940 A * 6/1987 Brockhaus ..... 16/273
5,463,795 A * 11/1995 Carlson et al. ..... 16/273
5,906,029 A * 5/1999 Fox ..... 16/386
6,732,408 B2 * 5/2004 Wu ..... 16/298

FOREIGN PATENT DOCUMENTS

GB 2119434 A * 11/1983
JP S38-28105 12/1963
JP 52063548 A * 5/1977
JP S60-90369 U 6/1985
JP H8-193453 A 7/1996
JP H11-006355 A 1/1999
JP 2983873 B2 11/1999
JP 2001-152727 A 6/2001

* cited by examiner

*Primary Examiner*—Robert J. Sandy
(74) *Attorney, Agent, or Firm*—Osha Liang LLP

(57) ABSTRACT

A first bush is attached to each of the opposite end parts of a first cylindrical part of a first hinge member. Second bushes are attached respectively to the inner end parts of second cylindrical parts which are disposed at the opposite end parts of a second hinge member and to the opposite end parts of a second cylindrical part which is disposed at the central part of the second hinge member. The first bush is provided with a protection cylindrical part. This protection cylindrical part is fitted to the outer periphery of the first cylindrical part. The second bush is provided with a second protection cylindrical part. This second protection cylindrical part is fitted to the outer periphery of the second cylindrical part.

16 Claims, 8 Drawing Sheets

HINGE

TECHNICAL FIELD

This invention relates to a hinge which is suited to be used in a clean room, etc. for manufacturing precise parts.

BACKGROUND ART

In general, a hinge of this type, as disclosed in Japanese Patent Application Laid-Open Application No. 2001-152727, comprises a first and a second hinge member which are made of metal, a bush which is made of synthetic resin and a hinge pin which is made of metal. The first and second hinge members include first and second planar attachment plate parts, and first and second cylindrical parts disposed at one side parts of the attachment plate parts, respectively. The first and second cylindrical parts are arranged with their axes aligned to each other. The bush includes an insertion cylindrical part and a flange part formed on one end part of the outer peripheral surface of the insertion cylindrical part. The insertion cylindrical part is inserted, for example, in the first cylindrical part. The flange part is sandwiched between the adjacent end faces of the first and second cylindrical parts. The hinge pin is turnably inserted in the first cylindrical part through the insertion cylindrical part and non-turnably inserted in the second cylindrical part. Owing to this arrangement, the first and second cylindrical parts are turnably connected to each other through the hinge pin and thus, the first and second hinge members are turnably connected to each other through the hinge pin.

In the hinge thus constructed, when the first and second hinge members are turned, the respective end faces of the first and second cylindrical parts are slide-contacted with each other, and the inner peripheral surface of the first cylindrical part and the outer peripheral surface of the hinge pin are slide-contacted with each other. The formers are slide-contacted with each other through the flange part and the latters are slide-contacted with each other through the insertion cylindrical part. Owing to this arrangement, according to the above-mentioned hinge, the respective metal parts are not directly slide-contacted with each other, but they are slide-contacted with each other through a bush which is made of synthetic resin. Thus, fine metal powder dust can be prevented from generating.

In the above-mentioned conventional hinge, however, no consideration is paid to metal powder dust at all which will be generated when the first and second cylindrical parts are accidentally collided with other metal-made member(s). That is, the outside diameters of the first and second cylindrical parts are normally larger than the thicknesses of the planar first and second attachment plate parts, and the first and second cylindrical parts are partially greatly projected forward from the front surfaces of the first and second attachment plate parts, respectively. Accordingly, when the first and second attachment plate parts are attached to the frame and the door, the first and second cylindrical parts are greatly projected from the respective attachment surfaces of the frame and the door. Owing to this arrangement, there is such a fear that goods under transportation are collided with the outer peripheral surfaces of the first and second cylindrical parts or those outer surfaces are rubbed with the goods under transportation. In case the goods are made of metal or other hard material, there is such a fear that metal powder dust is generated from the outer peripheral surfaces of the first and second cylindrical parts.

DISCLOSURE OF THE INVENTION

This invention has been made in order to solve the above-mentioned problem. According to the present invention, there is provided a hinge comprising a hinge comprising a metal-made first hinge member including a first attachment plate part and a first cylindrical part disposed along one side part of the first attachment plate part with at least one part of the first cylindrical part projecting forward from a front surface of the first attachment plate part, a metal-made second hinge member including a second attachment plate part and a second cylindrical part disposed along one side part of the second attachment plate part with at least a part of the second cylindrical part projecting forward from a front surface of the second attachment plate part, a metal-made hinge pin inserted in the first and second cylindrical parts whose axes are aligned to each other and adapted to relatively turnably interconnect the first and second cylindrical parts, and a synthetic resin-made bush including an insertion cylindrical part inserted between an inner peripheral surface of the first cylindrical part and an outer peripheral surface of the hinge pin and movable with respect to at least one of the first cylindrical part and the hinge pin, and a flange part formed on one end part of the insertion cylindrical part in such a manner as to project radially outward therefrom and contacted with an end face of the first cylindrical part, the flange part being interposed between mutually opposing end faces of the first and second cylindrical parts, wherein a protection cylindrical part extending in the same direction as the insertion cylindrical part from the flange part and externally inserted to an outer peripheral surface of the first cylindrical part is integrally disposed at an outer peripheral part of the flange part, and the hinge further comprising a synthetic resin-made second bush, the second bush including a second protection cylindrical part and a second flange part integrally disposed at one end part of the second protection cylindrical part and projecting radially inward of the second protection cylindrical part, the second protection cylindrical part being externally inserted to the second cylindrical part, the second flange part being contacted with the end face of the second cylindrical part, the opposing end faces of the first and second cylindrical parts with the second flange part disposed therebetween being press-contacted with each other through the flange part and the second flange part.

It is preferred that a second insertion cylindrical part extending in the same direction as the second protection cylindrical part from the second flange part is integrally disposed at an inner peripheral part of the second flange part of the second bush, the second insertion cylindrical part is inserted between an inner peripheral surface of the second cylindrical part and an outer peripheral surface of the hinge pin, and the hinge pin is turnably inserted to the second insertion cylindrical part.

It is also preferred that the bush is disposed at each of the opposite end parts of the first cylindrical part.

Preferably, a first cutout part extending from one end face of the protection cylindrical part toward the flange part is formed at the protection cylindrical part, the first cutout part allowing the first attachment plate part to be inserted therein, and a second cutout part extending from one end face of the second protection cylindrical part toward the second flange part is formed at the second protection cylindrical part, the second cutout part allowing the second attachment plate part to be inserted therein.

BRIEF DESCRIPTION OF DRAWINGS

FIG. 1 is a view showing a first embodiment of the present invention.

BEST MODE FOR CARRYING OUT THE INVENTION

Figure 1A:
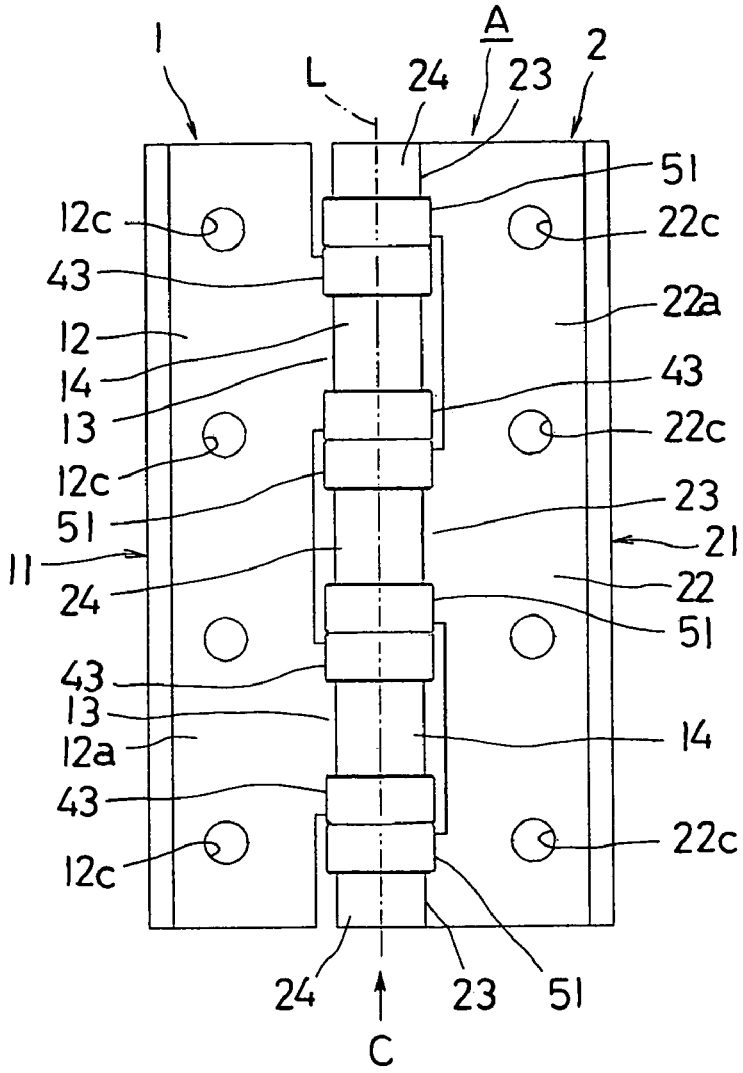
FIG. 1(A) is a front view thereof.
Figure 1B:
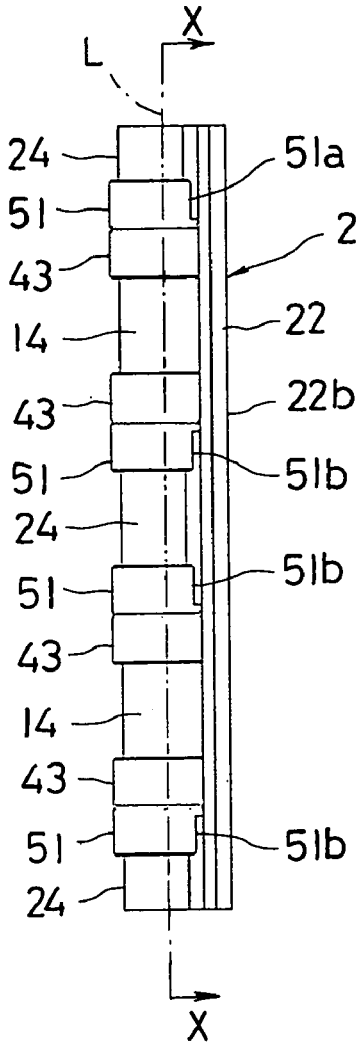
FIG. 1(B) is a side view thereof and FIG. 1(C) is a view, when viewed in a direction as indicated by an arrow C of FIG. 1(A).
Figure 1C:
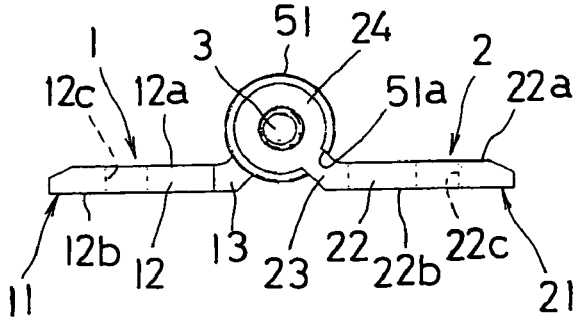
Figure 2:
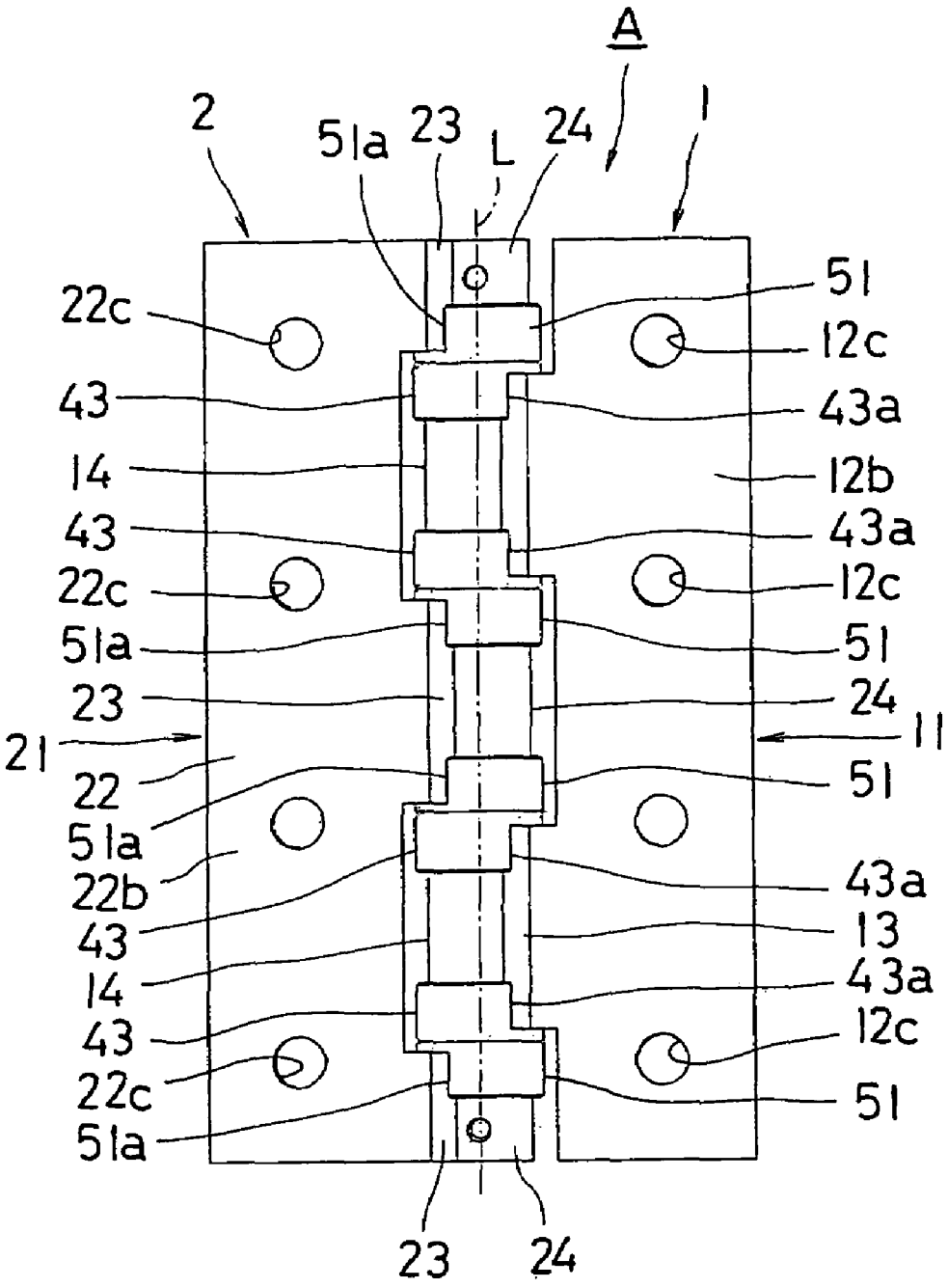
FIG. 2 is a rear view of the above-mentioned first embodiment.

Embodiments of the present invention will be described hereinafter with reference to FIGS. 1 through 10.

FIGS. 1 through 5 show a first embodiment of the present invention. A hinge A according to this embodiment comprises a first hinge member 1, a second hinge member 2, a hinge pin 3, a first bush (bush) 4 and a second bush 5.

The first hinge member 1 is entirely made of metal such as aluminum. The first hinge member 1 includes a first attachment plate part 11. This first attachment plate part 11 comprises a flat plate part 12 having a rectangular configuration in a plan view, and a connecting plate part 13 connected to one side part along the longitudinal direction of the flat plate part 12 and projecting slantwise forward from the flat plate part 12. An attachment hole 12*c* is formed in the flat plate part 12 in such a manner as to pass through the back surface 12*b* from the front surface 12*a*. A machine screw (not shown) inserted in this attachment hole 12*c* is threadingly engaged with a skeleton or door (none of them is shown) and tightened, thereby the back surface 12*b* of the flat part 12 is urged against the skeleton or door and the first attachment plate part 11 is fixed to the skeleton or door.

In this embodiment, two connecting plate parts 13 are formed in a way spaced apart in the longitudinal direction of the flat plate part 12. One, or three or more of the connecting plate parts 13 may be formed. The connecting plate part 13 is provided with a first cylindrical part 14 at a distal end part in the projecting direction of the connecting plate part 13. The first cylindrical part 14 is in a cylindrical shape whose opposite ends are open. The first cylindrical part 14 is disposed along one side part of the flat plate part 12, i.e., with its axis placed parallel to the longitudinal direction of the flat plate part 12. The outside diameter of the first cylindrical part 14 is set to be larger than the thickness of the flat plate part 12. The first cylindrical part 14 is arranged such that one side part on the back surface 12*b* side of its outer peripheral surface is located forward of the back surface 12*b*. As a result, the most part of the first cylindrical part 14 is located forward of the front surface 12*a* of the flat plate part 12. The back and forth distance between one side part on the back surface 12*b* side of the outer peripheral surface of the first cylindrical part 14 and the back surface 12*b* is set to be slightly larger than the thickness of the peripheral wall part of the protection cylindrical part 43 of the first bush 4 which is described later.

The second hinge member 2 is entirely made of metal such as aluminum. The second hinge member 2 includes a second attachment plate part 21. This second attachment part 21 comprises a flat plate part 22 having a rectangular configuration in a plan view, and a connecting plate part 23 connected to one side part (side part on the first hinge member 1 side) along the longitudinal direction of the flat plate part 22 and projecting slantwise forward toward the first hinge member 1 from the flat plate part 22. The flat plate part 22 is symmetrical with the flat plate part 12. Accordingly, an attachment hole 22*c* is also formed in this flat plate part 22 in such a manner as to pass through the back surface 22*b* from the front surface 22*a*. A machine screw (not shown) inserted in this attachment hole 22*c* is threadingly engaged with the door or skeleton and tightened, thereby the back surface 22*b* of the flat plate part 22 is urged against the door or skeleton and the second attachment plate part 21 is fixed to the door or skeleton.

The connecting plate part 23 is projected forward by the same amount as the connecting plate part 13. However, three connecting plate parts 23 are formed in a way as to be spaced apart in the longitudinal direction of the flat plate part 22, while two connecting plate parts 23 are formed in the case with the first hinge member 1. One, two, or four or more connecting plate parts 23 may be formed. The connecting plate part 23 is provided with a second cylindrical apart 24 at a distal end part in the projecting direction of the connecting plate part 23. The second cylindrical part 24 is in a cylindrical shape whose opposite ends are open. The second cylindrical part 24 is disposed along one side part of the flat plate part 22, i.e., with its axis placed parallel to the longitudinal direction of the flat plate part 22. The second cylindrical part 24 has the same outside diameter as the first cylindrical part 14. Accordingly, the outside diameter of the second cylindrical part 24 is larger than the thickness of the flat plate part 22. The second cylindrical part 24 is arranged such that one side part on the back surface 22*b* side of its outer peripheral surface is located forward of the back surface 22*b*. As a result, the most part of the second cylindrical part 24 is located forward of front surface 22*a* of the flat plate part 22. The back and forth distance between one side part on the back surface 22*b* side of the outer peripheral surface of the second cylindrical part 24 and the back surface 22*b* is set to be equal to the back and forth distance between one side part on the back surface 12*b* of the outer peripheral surface of the first cylindrical part 14 and the back surface 12*b*. The inside diameter of the second cylindrical part 24 is smaller than the inside diameter of the first cylindrical part 14.

The first cylindrical part 14 and the second cylindrical part 24 are alternately arranged with their axes L aligned to each other. As a result, the first cylindrical part 14 is inserted between the axially adjacent two second cylindrical parts 24, 24, and the second cylindrical part 24 is inserted between the axially adjacent two first cylindrical parts 14, 14. Since two first cylindrical parts 14 and three second cylindrical parts 24 are employed in this embodiment, the first cylindrical part 14 disposed at one end side in the direction of the axis L is inserted between the second cylindrical part 24 disposed at the above-mentioned one end side and the second cylindrical part 24 disposed at the center, the first cylindrical part 14 disposed at the other end side is inserted between the second cylindrical part 24 disposed at the other end side and the second cylindrical part 24 disposed at the center, and the second cylindrical part 24 disposed at the center is inserted between the first cylindrical parts 14, 14. Of course, such an arrangement relation between the first cylindrical part 14 and the second cylindrical part 24 can suitably be changed depending on the number of the first and second cylindrical parts 14, 24 under the condition that the first and second cylindrical parts 14, 24 are alternately arranged with their axes aligned to each other.

Figure 3:
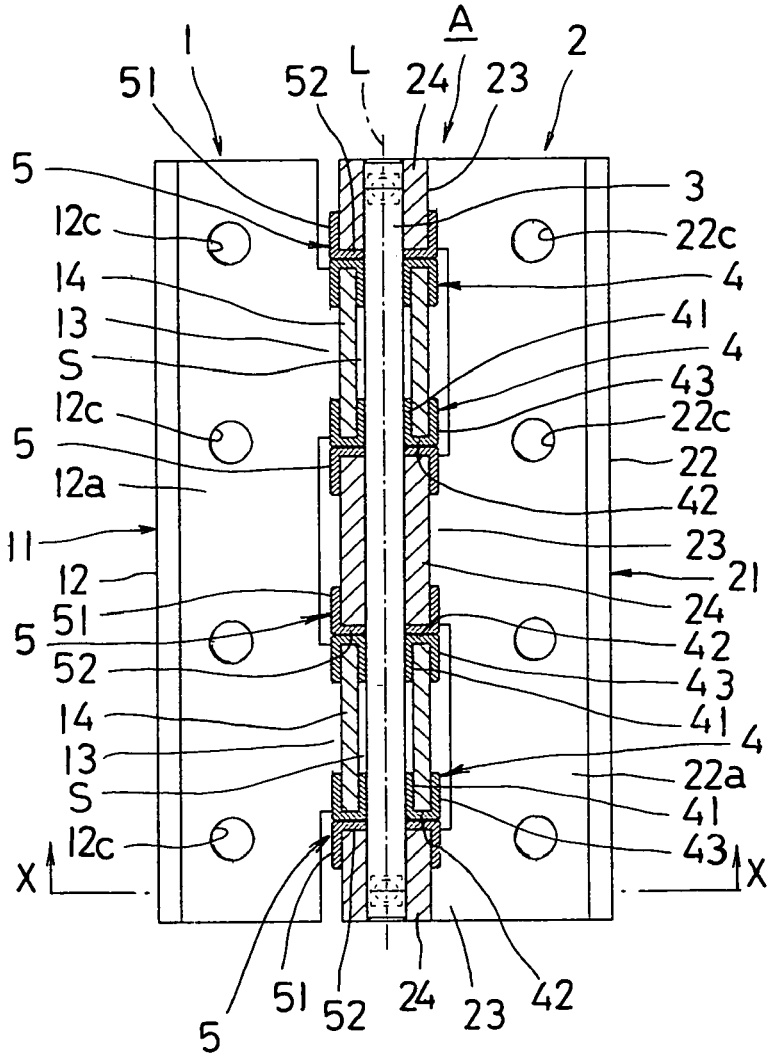
FIG. 3 is a sectional view taken on line X-X of FIG. 1(B).
Figure 4:
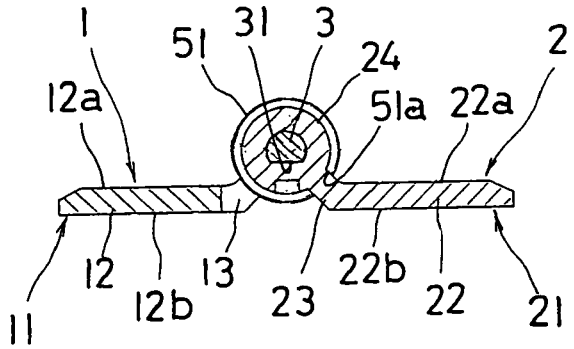
FIG. 4 is a sectional view taken on line X-X of FIG. 3.
Figure 5:
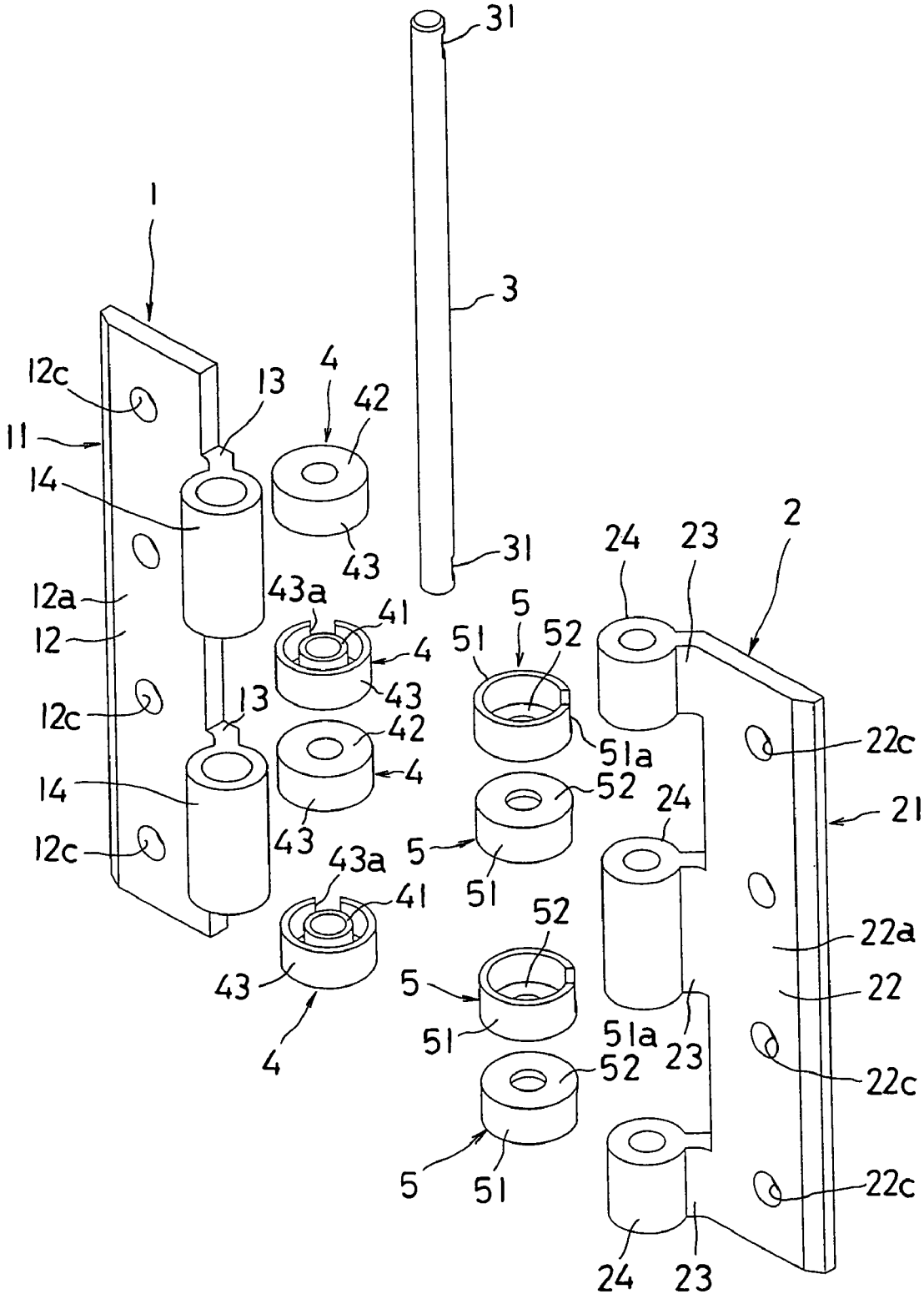
FIG. 5 is an exploded perspective view of the above-mentioned first embodiment.
Figure 6:
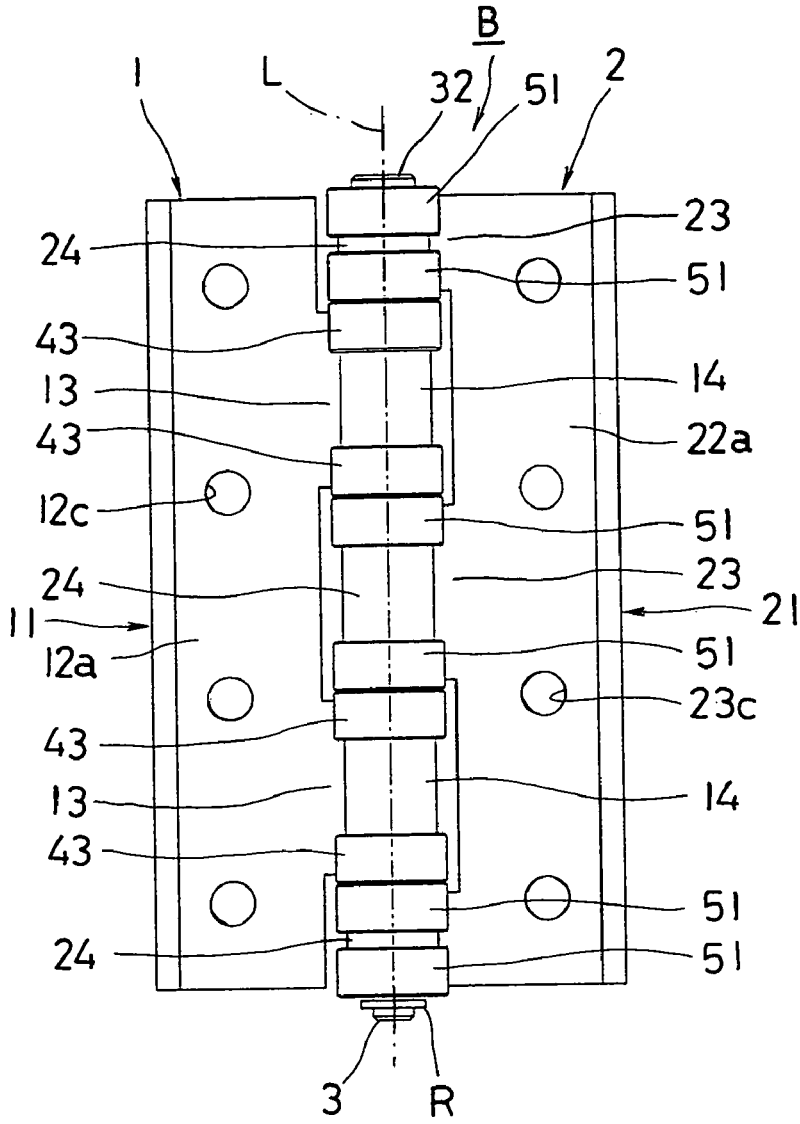
FIG. 6 is a front view showing a second embodiment of the present invention.
Figure 7:
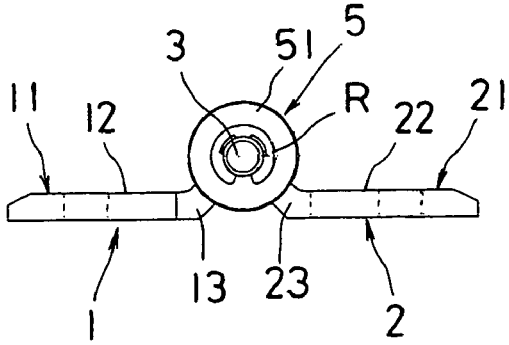
FIG. 7 is a view, like FIG. 1(C), but showing the above-mentioned second embodiment.
Figure 8:
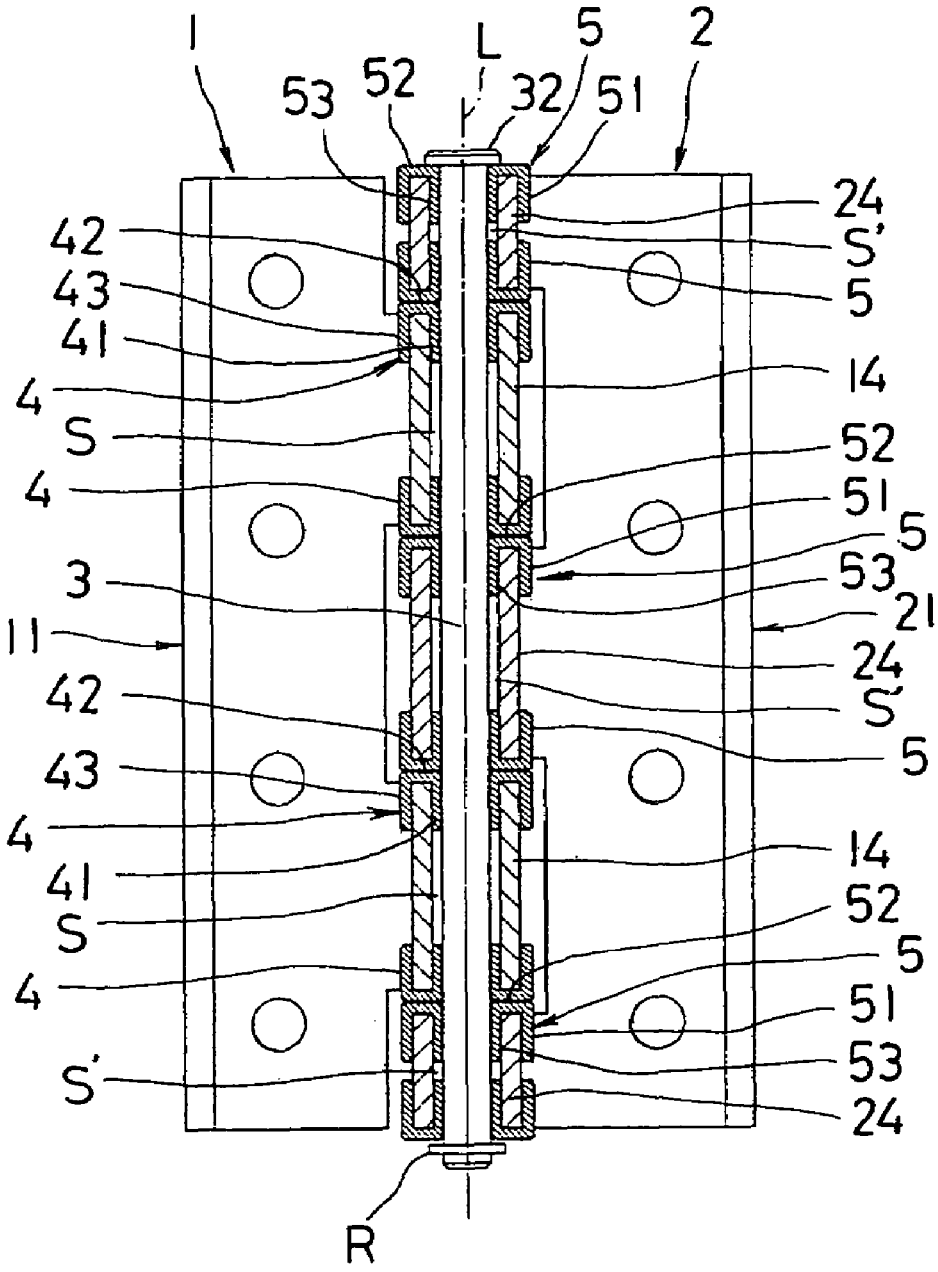
FIG. 8 is a sectional view, like FIG. 3, but showing the above-mentioned second embodiment.
Figure 9:
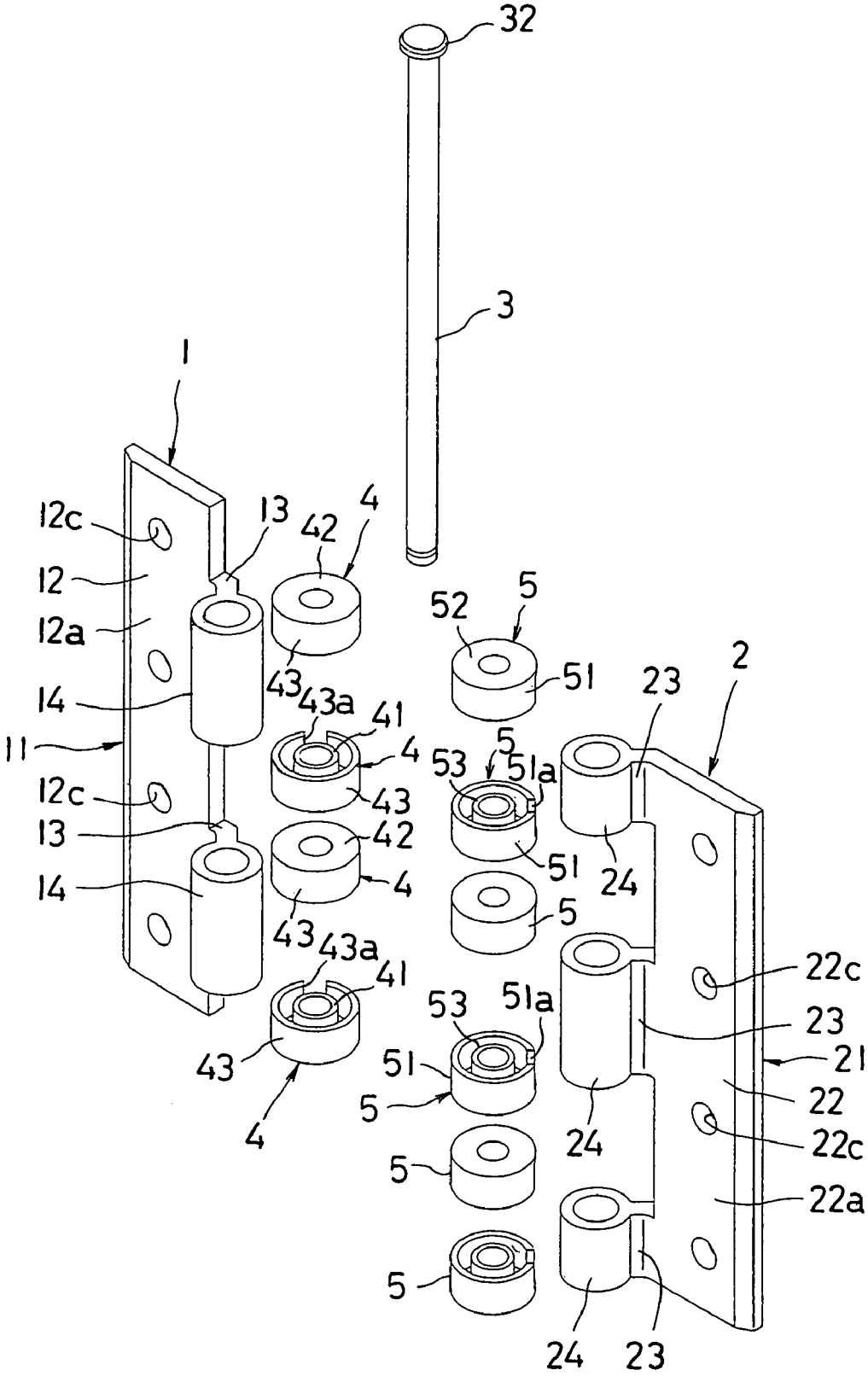
FIG. 9 is an exploded perspective view of the above-mentioned second embodiment.

The hinge pin 3 is made of metal such as aluminum. The hinge pin 3 is formed in a straight rod-like shape having a circular configuration in section. As shown in FIG. 3, the hinge pin 3 is inserted between the first cylindrical part 14 and the second cylindrical part 24. The outside diameter of the hinge pin 3 is set to be generally equal to the inside diameter of the second cylindrical part 24. Accordingly, the outside diameter of the hinge pin 3 is smaller than the inside diameter of the first cylindrical part 14. As shown in FIG. 4, a flat surface part 31 is formed on the outer peripheral surface of each opposite end of the hinge pin 3 inserted in each second cylindrical part 24 on each opposite side in the direction of the axis L. The peripheral wall part of the second cylindrical part 24 opposite to this flat surface part 31 is caulked toward the flat surface part 31 so that the inner peripheral surface of the second cylindrical part 24 is press-contacted with the flat surface part 31, thereby the opposite end parts of the hinge pin 3 are non-turnably inserted in the second cylindrical parts 24, 24. An annular space S having a thickness (radial width) equal to the difference of the radii between the outer peripheral surface of the hinge pin 3 and the inner peripheral surface of the first cylindrical part 14 is formed between the outer peripheral surface of the hinge pin 3 and the inner peripheral surface of the first cylindrical part 14.

The first bush 4 is attached to each end part of the first cylindrical part 14. The first bush 4 is made of synthetic resin excellent in wear resistance and small in friction resistance, such as polyacetal resin, polyamide resin and fluororesin. The first bush 4 includes a straight insertion cylindrical part 41 having a circular configuration in section and whose opposite ends are open, a flange part 42 formed on the outer peripheral surface of one end part of this insertion cylindrical part 41 and projecting radially outward of the insertion cylindrical part 41, and a sectionally circular protection cylindrical part 43 extending in the same direction as the insertion cylindrical part 41 from the outer peripheral part of the flange part 42. The protection cylindrical part 43 is formed such that its axis is aligned with that of the insertion cylindrical part 41.

The insertion cylindrical part 41 is generally same in sectional configuration and dimension as those of the annular space S, and the insertion cylindrical part 41 is inserted in this space S. The hinge pin 3 is turnably inserted in the inner periphery of the insertion cylindrical part 41. As a result, the first cylindrical part 14 is turnably connected to the second cylindrical part 24 through the insertion cylindrical part 41 and the hinge pin 3 and thus, the first hinge member 1 and the second hinge member 2 are turnably connected to each other about the axis L through the hinge pin 3.

The flange part 42 is abutted with the end face of the first cylindrical part 14. Since the length of the insertion cylindrical part 14 is smaller than a half the length of the first cylindrical part 14, the respective opposing end faces of the insertion cylindrical parts 41, 41 which are inserted in one and the other ends of the space S are spaced apart from each other. It is accepted, however, that the length of the insertion cylindrical part 14 is set to be generally equal to a half the length of the first cylindrical part 14 and the respective end faces of the insertion cylindrical parts 41, 41 are generally contacted with each other.

The inside diameter of the protection cylindrical part 43 is set to be generally equal to the outside diameter of the first cylindrical part 14, and the protection cylindrical part 43 is fitted to the outer periphery of the first cylindrical part 14. A cutout part 43*a* extending so far as to contact the flange part 42 from the end face of the protection cylindrical part 43 is formed at one side part in the peripheral direction of the peripheral wall part of the protection cylindrical part 43. The width of this cutout part 43*a* is set to be generally equal to the thickness of the connecting plate part 13. The connecting plate part 13 is inserted in the cutout part 43*a*. By this, the protection cylindrical part 43 can fit to the outer periphery of the first cylindrical part 43 and becomes non-turnable with respect to the first cylindrical part 14. The length of the protection cylindrical part 43 is smaller than a half the length of the first cylindrical part 14. It is accepted, however, that the length of the protection cylindrical part 43 is set to be generally equal to a half the length of the first cylindrical part 14 and the mutually opposing end faces of the protection cylindrical parts 43, 43 fitted to the opposite end parts of the first cylindrical part 14 are generally contacted with each other, when the flange part 42 is contacted with the end face of the first cylindrical part 14. By this, the entire first cylindrical part 14 only excluding the area where the connecting plate part 13 is formed may be covered with the protection cylindrical parts 43, 43.

The second bushes 5 are attached respectively to the inner (on the central second cylindrical part 24 side) end parts of the second cylindrical parts 24, 24 which are arranged at the opposite end parts in the longitudinal direction of the second attachment plate part 21 and to the opposite end parts of the second cylindrical part 24 which is arranged at the central part of the second attachment plate part 21. The second bush 5 is made of synthetic resin excellent in wear resistance and small in friction resistance, such as polyacetal resin, polyamide resin and fluororesin. The second bush 5 includes a straightly extending second protection cylindrical part 51 having a circular configuration in section and whose opposite ends are open, and an annular second flange part 52 projecting radially inward from the inner peripheral surface of one end part of this protection cylindrical part 51.

The inside diameter of the second protection cylindrical part 51 is set to be generally equal to the outside diameter of the second cylindrical part 24, and the second protection cylindrical part 51 is fitted to the outer periphery of the second cylindrical part 24. A cutout part 51*a* extending so far as to the second flange part 52 from the end face of the second protection cylindrical part 51 is formed at one side part in the peripheral direction of the peripheral wall part of the second protection cylindrical part 51. The width of this cutout part 51*a* is set to be generally equal to the thickness of the connecting plate part 23. The connecting plate part 23 is inserted in the cutout part 51*a*. By this, the second protection cylindrical part 51 can fit to the outer periphery of the second protection cylindrical part 51 and becomes non-turnable with respect to the second cylindrical part 24. The length of the second protection cylindrical part 51 is smaller than the length of the second cylindrical parts 24 which are arranged at the opposite end parts and smaller than a half the length of the second cylindrical part 24 which is arranged at the central part. It is accepted, however, that the length of the second protection cylindrical part 51 fitted to the second cylindrical parts 24 which are arranged at the opposite end parts is set to be generally equal to the length of the second cylindrical part 24 and the entire outer peripheral surface only excluding an area where the connecting plate part 23 is formed, of the second cylindrical part 24 which is arranged at each opposite end part is covered with the second protection cylindrical part 51. It is also accepted that the length of the second protection cylindrical part 51 fitted to the second cylindrical part 24 which is arranged at the central part is set to be generally equal to a half the length of the second cylindrical part 24, so that the mutually opposing end faces of the second protection cylindrical parts 51, 51 are generally contacted with each other.

The second flange part 52 is contacted with the end face of the second cylindrical part 24 opposing the first cylindrical part 14 and also contacted with the flange part 42 of the first bush 4. As a result, the flange part 42 and the second flange part 52 are sandwiched between the mutually opposing end faces of the first and second cylindrical parts 14, 24.

In the hinge thus constructed, when the first and second hinge members 1, 2 are mutually turned about the axis L, the respective end faces of the first and second cylindrical parts 14, 24 are turned relative to each other, and the hinge pin 3 is turned relative to the first cylindrical part 14. At that time, since the flange parts 42, 52 of the first and second bushes 4, 5 are interposed between the end faces of the first and second cylindrical parts 14, 24, the respective end faces of the first and second cylindrical parts 14, 24 are not directly slide-contacted with each other. Likewise, since the insertion cylindrical part 41 is interposed between the outer peripheral surface of the hinge pin 3 and the inner peripheral surface of the first cylindrical part 14, the outer peripheral surface of the hinge pin 3 and the inner peripheral surface of the first cylindrical part 14 are not directly slide-contacted with each other. Accordingly, no metal powder dust is generated at the time of the turning operation of the first and second hinge members 1, 2.

Since the first and second cylindrical parts 14, 24 are projected forward from the front surfaces 12*a*, 22*a* of the first and second attachment plate parts 11, 21, there is a likelihood that goods under transportation are collided and easily rubbed with the first and second cylindrical parts 14, 24. However, the goods are collided with the protection cylindrical parts 43, 51 of the first and second bushes 4, 5 before the goods are collided with the first and second cylindrical parts 14, 24. Of course, there is a possibility that the goods are collided with the areas of the outer peripheral surfaces of the first and second cylindrical parts 14, 24 which are exposed from the protection cylindrical parts 43, 51. However, since the protection cylindrical parts 43, 51 are projected from the outer peripheral surfaces of the first and second cylindrical parts 14, 24 by a portion equal to the thickness of their peripheral wall parts, the chances for the goods to be collided with the exposed area of the outer peripheral surfaces of the first and second cylindrical parts 14, 24 are almost nothing. Instead, the goods are collided with the protection cylindrical parts 43, 51. Accordingly, it is possible to prevent the generation, which would otherwise be generated by the goods collided or rubbed with the outer peripheral surfaces of the first and second cylindrical parts 14, 24, of metal powder dust from the outer surfaces of the first and second cylindrical parts 14, 24.

Other embodiments of the present invention will be described next. In the embodiments to be described, only those component parts different from those of the above embodiment, and the identical component parts with those of the above embodiment are denoted by identical reference numerals and description thereof is omitted.

FIGS. 6 through 9 show a second embodiment of the present invention. In a hinge B according to this embodiment, the inside diameter of the second cylindrical part 24 is set to be equal to the inside diameter of the first cylindrical part 14. As a result, an annular space S' having the same sectional configuration and sectional dimension as those of the space S formed between the inner peripheral surface of the first cylindrical part 14 and the outer peripheral surface of the hinge pin 3 is formed between the inner peripheral surface of the second cylindrical part 24 and the outer peripheral surface of the hinge pin 3.

A second insertion cylindrical part 53 extending in the same direction as a second protection cylindrical part 51 with its axis aligned with that of the second protection cylindrical part 51 is formed at the inner peripheral part of a second flange part 52 of a second bush 5. The second insertion cylindrical part 53 has the same sectional configuration and sectional dimension as those of the insertion cylindrical part 41 and is inserted in the space S'. As a result, the hinge pin 3 is turnably inserted in the second cylindrical part 24 through the second insertion cylindrical part 53. The second bushes 5 are also attached respectively to the outer end parts of two second cylindrical parts 24, 24 which are arranged at the opposite end parts in the longitudinal direction of the second attachment plate part 21.

The opposite end parts of the hinge pin 3 are projected outward from the second cylindrical parts 24, 24 which are arranged on the outer side. A head part 32 is formed on one end part of the hinge pin 3 projecting from the second cylindrical part 24 (upper second cylindrical part 24 in FIGS. 6 and 8). The head part 32 is contacted with the outer end face of this second cylindrical part 24 through the second flange part 51 of the second bush 5. A stopper ring R such as an E-ring is attached to the other end part of the hinge pin 3 projecting from the other second cylindrical part 24 such that the stopper R is non-movable in the direction of the axis L. This stopper ring R is contacted with the outer end face of the other second cylindrical part 24 through the second flange part 51 of the second bush 5. By the head part 32 and the stopper ring R, the hinge pin 3 is prevented from escaping with respect to the first and second cylindrical parts 14, 24 in such a manner as that the hinge pin 3 is non-movable in the direction of the axis L.

Figure 10:
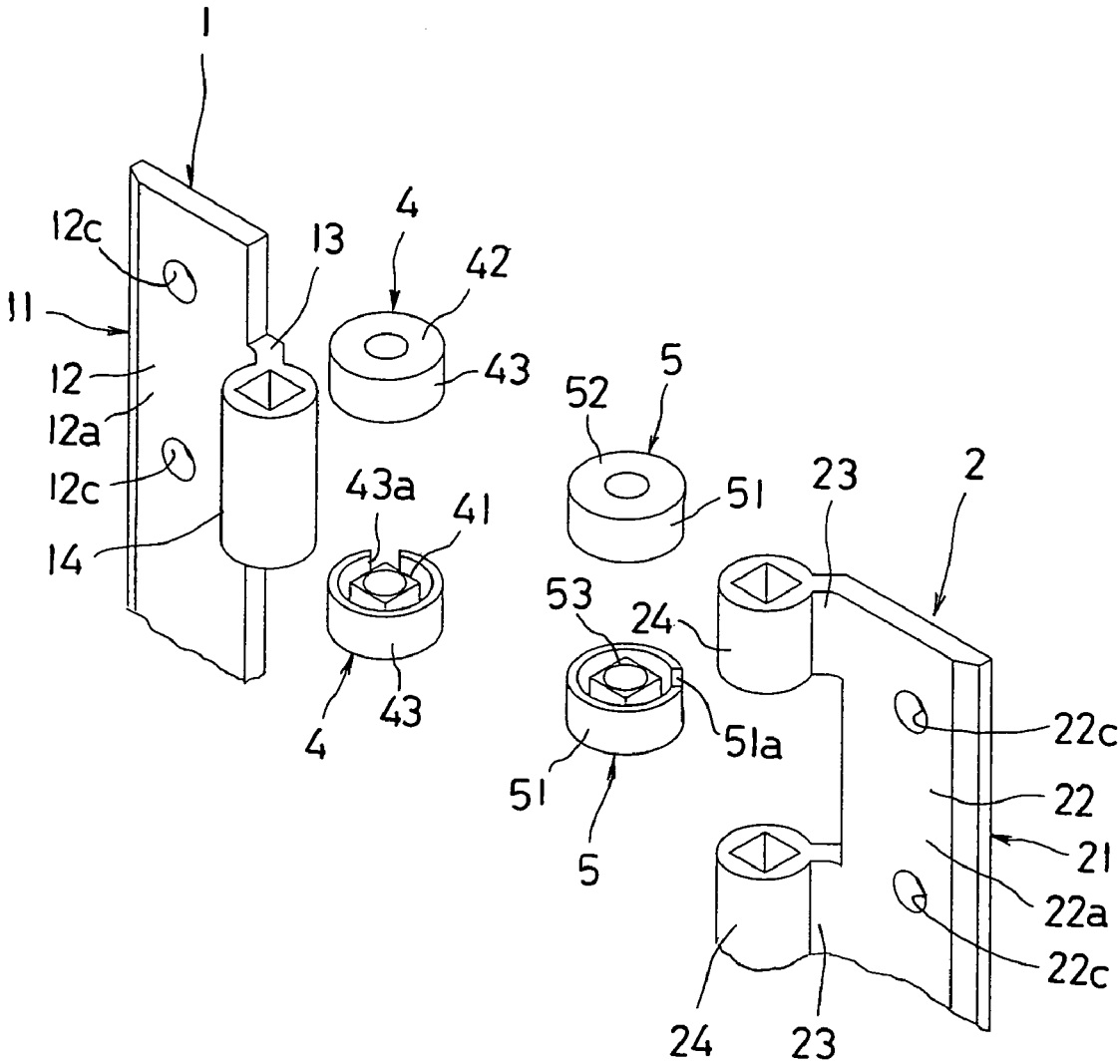
FIG. 10 is an exploded perspective view, partly omitted, showing a third embodiment of the present invention.

FIG. 10 shows a third embodiment of the present invention. In this embodiment, the inner peripheral surface of a first cylindrical part 14 is formed in a regular square configuration in section. In accordance with the configuration of the first cylindrical part 14, the outer peripheral surface of an insertion cylindrical part 41 of a first bush 4 which is fitted to the first cylindrical part 14 is also formed in a regular square configuration in section. The inner peripheral surface of a second cylindrical part 24 and the outer peripheral surface of a second insertion cylindrical part 53 of a second bush 5 which is fitted to the second cylindrical part 24 are also formed in a regular square configuration in section. The remaining construction is same as the hinge B.

INDUSTRIAL APPLICABILITY

A hinge according to the present invention can be utilized as a hinge for openably/closably and turnably attaching a door for opening/closing an entrance/exit of a clean room, or the like to a skeleton.

The invention claimed is:

1. A hinge comprising a metal-made first hinge member including a first attachment plate part and a first cylindrical part disposed along one side part of said first attachment plate part with at least one part of said first cylindrical part projecting forward from a front surface of said first attachment plate part, a metal-made second hinge member including a second attachment plate part and a second cylindrical part disposed along one side part of said second attachment plate part with at least a part of said second cylindrical part projecting forward from a front surface of said second attachment plate part, a metal-made hinge pin inserted in said first and second cylindrical parts, said first and second cylindrical parts having axes aligned to each other, said metal-made hinge pin adapted to relatively turnably interconnect said first and second cylindrical parts, and a synthetic resin-made bush including an insertion cylindrical part inserted between an inner peripheral surface of said first cylindrical part and an outer peripheral surface of said hinge pin and movable with respect to at least one of said first cylindrical part and said hinge pin, and a flange part formed on one end part of said insertion cylindrical part in such a manner as to project radially outward therefrom and contacted with an end face of said first cylindrical part, said flange part being interposed between mutually opposing end faces of said first and second cylindrical parts, wherein a protection cylindrical part extending in the same direction as said insertion cylindrical part from said flange part and externally inserted to an outer peripheral surface of said first cylindrical part is integrally disposed at an outer peripheral part of said flange part, and said hinge further comprising a synthetic resin-made second bush, said second bush including a second protection cylindrical part and a second flange part integrally disposed at one end part of said second protection cylindrical part and projecting radially inward of said second protection cylindrical part, said second protection cylindrical part being externally inserted to said second cylindrical part, said second flange part being contacted with an end face of said second cylindrical part, said opposing end faces of said first and second cylindrical parts with said second flange part disposed therebetween being press-contacted with each other through said flange part and said second flange part.

2. A hinge according to claim 1, wherein a second insertion cylindrical part extending in the same direction as said second protection cylindrical part from said second flange part is integrally disposed at an inner peripheral part of said second flange part of said second bush, said second insertion cylindrical part is inserted between an inner peripheral surface of said second cylindrical part and an outer peripheral surface of said hinge pin, and said hinge pin is turnably inserted to said second insertion cylindrical part.

3. A hinge according to claim 2, wherein said bush is disposed at each of the opposite end parts of said first cylindrical part.

4. A hinge according to claim 3, wherein said second bush is disposed at each of the opposite end parts of said second cylindrical part.

5. A hinge according to claim 4, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

6. A hinge according to claim 3, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

7. A hinge according to claim 2, wherein said second bush is disposed at each of the opposite end parts of said second cylindrical part.

8. A hinge according to claim 7, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

9. A hinge according to claim 2, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

10. A hinge according to claim 1, wherein said bush is disposed at each of the opposite end parts,of said first cylindrical part.

11. A hinge according to claim 10, wherein said second bush is disposed at each of the opposite end parts of said second cylindrical part.

12. A hinge according to claim 11, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

13. A hinge according to claim 10, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

14. A hinge according to claim 1, wherein said second bush is disposed at each of the opposite end parts of said second cylindrical part.

15. A hinge according to claim 14, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

16. A hinge according to claim 1, wherein a first cutout part extending from one end face of said protection cylindrical part toward said flange part is formed at said protection cylindrical part, said first cutout part allowing said first attachment plate part to be inserted therein, and a second cutout part extending from one end face of said second protection cylindrical part toward said second flange part is formed at said second protection cylindrical part, said second cutout part allowing said second attachment plate part to be inserted therein.

* * * * *